US005467550A

United States Patent [19]

Mumbleau

[11] Patent Number: 5,467,550

[45] Date of Patent: Nov. 21, 1995

[54] PASSIVE SAFETY MECHANISM FOR FIREARMS

[76] Inventor: Dean W. Mumbleau, 14841 Pine View Dr., Becker, Minn. 55308-9212

[21] Appl. No.: 159,001

[22] Filed: Nov. 29, 1993

[51] Int. Cl.[6] ..... F41A 17/02

[52] U.S. Cl. ..... 42/70.11

[58] Field of Search ..... 42/70.08, 70.11, 42/70.02, 7

[56] References Cited

U.S. PATENT DOCUMENTS

| | | | |
|---|---|---|---|
| 3,673,725 | 7/1972 | Cravener . | |
| 3,882,622 | 5/1975 | Perlotto | 42/70.11 |
| 4,014,123 | 3/1977 | Williams . | |
| 4,136,475 | 1/1979 | Centille . | |
| 4,384,420 | 5/1983 | Von Muller . | |
| 4,532,729 | 8/1985 | Von Muller | 42/70.11 |
| 4,590,697 | 5/1986 | Ruger et al. | 42/70.08 |
| 4,726,136 | 2/1988 | Dornaus et al. | 42/70.08 |
| 4,763,431 | 8/1988 | Allan et al. . | |
| 4,768,302 | 9/1988 | Beretta | 42/70.08 |
| 4,987,693 | 1/1991 | Brooks | 42/70.11 |
| 5,090,148 | 2/1992 | Brooks . | |
| 5,140,766 | 8/1992 | Brooks . | |
| 5,245,776 | 9/1993 | Dornaus | 42/70.08 |

OTHER PUBLICATIONS

Smith & Wesson Centerfire Pistol Exploded View Diagram. 1993 Smith & Wesson Products for Law Enforcement Catalog.

*Primary Examiner*—Charles T. Jordan
*Attorney, Agent, or Firm*—Philip G. Alden

[57] ABSTRACT

A passive safety mechanism is shown installed in a semi-automatic pistol. The passive safety mechanism includes a cylindrical body rotatably mounted within the slide assembly which may be rotated between an engaged position and a disengaged position using a key inserted into a keyway in the exposed axial end of the cylindrical body. In the engaged position, a portion of the body blocks the hammer assembly from contacting the firing pin, and a circumferential surface depresses the ejector and magazine depressor lever and firing pin safety lever. Rotation of the cylindrical body within the slide assembly is prevented or resisted through friction and spring tension created by a spring-biased pin carried in a transverse bore in the cylindrical body and riding within a channel in the slide assembly. One or both of the axial ends of the cylindrical body may be recessed from the sides of the slide assembly, polished to further prevent or evidence tampering, and the axial end opposing the keyway may optionally be covered. The semi-automatic pistol thereby has no manual safety lever.

14 Claims, 4 Drawing Sheets

PASSIVE SAFETY MECHANISM FOR FIREARMS

BACKGROUND OF THE INVENTION

1. Field of the Invention

This invention relates generally to devices for preventing the accidental or unintentional discharge of a firearm, and particularly to a passive safety mechanism that provides a locking capability.

2. Prior Art

Various types of active locking mechanisms for firearms are known. These mechanisms include: (1) bore locks which require the insertion of a lockable bar through the bore or barrel of the firearm, (2) trigger guard locks that enclose the trigger guard area to prevent insertion of a finger or block rearward movement of the trigger itself, and (3) frame-mounted locks which integrate an active locking mechanism into one or more operations of the firearm, such as the manual safety, hammer drawback or drop, or magazine insertion.

Representative examples of various frame-mounted active locking mechanisms are shown in U.S. Pat. Nos. 3,673,725 to Cravener; 3,882,622 to Perlotto; 4,014,123 to Williams; 4,136,475 to Centille; 4,384,420 and 4,532,729 to Von Muller; 4,763,431 to Allan; and 5,140,766; 5,090,148; and 4,987,693 to Brooks.

The Perlotto '622 patent discloses a locking mechanism particularly suited for semi-automatic pistols incorporating a hammer-blocking manual safety and a manual de-cocking mechanism, although that reference does not discuss the structure and operation of the "shaft" on which the manual safety lever is carried in relation to its functions in retaining the firing pin, blocking the hammer from contacting the firing pin when the manual safety is "on," interrupting the trigger pull or hammer release mechanisms, and preventing manual insertion or release of the magazine.

The Perlotto '622 active locking mechanism is operated utilizing a key which acts to rotate a cam that has an arcuate circumferential surface aligned with one half of the face of a spring-biased retractable pin. The cam has an angularly-oriented face which defines an orthogonal notch or recess facing the closely confronting end of the shaft and opposing the keyway. (The keyway therefore opposes the thumb-actuated safety lever relative to the frame of the semi-automatic pistol.) The interface between that cam and the confronting end of the shaft is aligned generally along the longitudinal axis of that retractable pin, with one half of that retractable pin being received within a groove or locking recess formed in the semi-circular projection extending from the end of the shaft confronting the cam, and the remaining half of the retractable pin being received within the orthogonal notch. Rotation of the key and cam through a quarter revolution (90°) to the "unlocked" position causes the angularly-oriented face of the cam to depress the retractable pin into the aligned bore in the frame to a point where the face of the retractable pin is at least flush with or spaced apart from the circumferential surface of the shaft on which the manual safety lever is mounted. The manual safety lever may then be pivoted to its "off" position, thus allowing a round of ammunition to be chambered from the magazine and the pistol to be fired. Depressing the retractable pin thereby pushes the retractable pin out of the locking recess to prevent that pin from obstructing the rotation of the shaft, and the manual safety lever can be pivoted back and forth to disengage or engage the safety as desired until the cam is subsequently rotated to the "locked" position, releasing the retractable pin into the locking recess and obstructing the rotation of the shaft and movement of the manual safety lever. Rotation of the cam to the "locked" position also disposes one surface of the orthogonal notch to a mating position with the corresponding surface on the projecting end of the shaft, further preventing rotation of the shaft.

The Perlotto '622 active locking mechanism does present several noteworthy limitations and drawbacks. First, although Perlotto '622 does constitute an active locking mechanism, the extension from the cam which the key engages is exposed through the keyway and can easily be manipulated or rotated by a person using a pliers, screwdriver, allen wrench, or similar tool depending upon the cross-sectional shape of the extension. As such, the Perlotto '622 locking mechanism is especially susceptible to circumvention or unauthorized use, and the exposed extension invites curiosity.

Perlotto '622 depicts a right-handed embodiment of the active locking mechanism. The keyway must necessarily be disposed on the opposite side of the frame from the thumb-actuated safety lever, thereby placing the keyway on the opposite side of the pistol from the shooter's free left hand. In order to place the key in the keyway and rotate the cam using the left hand while still gripping the pistol in the shooting hand, the pistol must be turned over (thus reversing the orientation for the conventional rotation of the key and lock) or inwardly toward the shooter's torso. These motions require extensive practice to perform smoothly, and can be time-consuming and dangerous in an emergency or life-threatening situation where a person may not think clearly or react calmly. The alternative is to shift the pistol to the non-shooting hand, which is again time consuming and dangerous for a person who lacks the proper training or is involved in an emergency or life-threatening situation.

Moreover, once the active locking mechanism has been disengaged, the firearm is returned to its normal mode of operation and is rendered equivalent to a firearm without a locking mechanism. A person is therefore as apt to engage the manual safety and set the firearm down, or place the firearm in storage without engaging the active locking mechanism, as they would be with a conventional firearm lacking any locking mechanism. To overcome this disadvantage, the active locking mechanism could be modified to lock the firearm each time the manual safety is engaged. However, a person might accidentally or unintentionally engage the manual safety in a situation where the firearm might be needed imminently, and the unlocking operation would then need to be repeated before the firearm could be fired.

The Perlotto '622 active locking mechanism also requires a retaining cap to enclose the elements of the locking mechanism that extend outwardly beyond the side of the slide assembly or frame. This requires either an extensive modification to the slide assembly design or else welding a cap over the locking mechanism, since a threaded cap and aperture could easily be removed to circumvent the locking mechanism.

Finally, the prevailing trend in the manufacture of semi-automatic pistols is to utilize an ambidextrous manual safety, and in many models an integrated de-cocking mechanism. However, the Perlotto '622 active locking mechanism requires that the slide assemblies and manual safeties be completely redesigned and re-tooled for each model of firearm incorporating the locking mechanism. Distinct frames, slide assemblies, and safeties must be fabricated for right- and left-handed firearms, and the orientation of the cam and shaft surfaces would also need to be reversed if the manual safety is disposed on the opposite or left-handed side of the firearm. This greatly increases the cost and complexity of manufacturing and implementing the Perlotto '622 locking mechanism in commercial firearms.

Moreover, the shaft on which the manual safety lever is carried in many semi-automatic pistols is the firing pin retainer, which has surfaces or detents which engage and interact with the firing pin safety lever and the ejector/magazine depressor lever, none of which are shown or discussed in Perlotto '622. Consequently, due to the placement of the firing pin safety lever and the ejector/magazine depressor lever, the Perlotto '622 locking mechanism could not be incorporated into both left- and right-handed firearms of this type without effectively creating two separate "mirror-image" firearms.

In any event, the Perlotto '622 design could not be incorporated into many of these modern semi-automatic pistols because insufficient space is permitted to place the cam and retractable pin in the area of the firing pin retainer. The thin walls of conventional slide assemblies do not permit a bore to be machined to hold the spring and retractable pin while still maintaining the integrity of the slide assembly, and many models of semi-automatic pistols utilize a larger diameter firing pin that consumes most of the free space in the rear block of the slide assembly. The location of the firing pin safety lever and the ejector/magazine depressor lever also prevents the cam and retractable pin from being placed on either side of the firing pin in many semi-automatic pistols.

BRIEF SUMMARY OF THE INVENTION

It is therefore one object of this invention to design a passive safety mechanism for firearms such as semi-automatic pistols which may be incorporated into existing firearm designs without modification of the frames, slide assemblies, or other functional elements of the firearm associated with the chambering mechanisms, firing mechanisms, or ejector mechanisms.

It is a related object of this invention to design the above passive safety mechanism such that it is slide-mounted and may be contained wholly within the existing boundaries of the slide assembly of a semi-automatic pistol.

It is another object of this invention to design the above passive safety mechanism so that it may not be operated manually by a person using their thumb or their thumb and forefinger, but rather requires a key or other actuating device.

It is a distinct object of this invention to design the above passive safety mechanism such that it resists or prevents tampering or circumvention, and will evidence attempts to tamper with or circumvent the passive safety mechanism by an unauthorized user.

It is yet another object of this invention to design the above passive safety mechanism such that the magazine of an semi-automatic pistol equipped with the passive safety mechanism cannot be inserted into an engaged position when the passive safety mechanism is engaged, and further such that a round cannot be stripped from the magazine and chambered by action of the slide assembly when the passive safety mechanism is engaged.

It is yet another object of this invention to design the above passive safety mechanism such that it may be manufactured in a cost effective manner, and permit ambidextrous use without increasing the cost of manufacture.

Briefly described, the preferred embodiment of the passive safety mechanism of this invention comprises a cylindrical body rotatably mounted within the slide assembly of a semi-automatic pistol which may be rotated between an engaged position and a disengaged position using a key inserted into a keyway in the exposed axial end of the cylindrical body. In the engaged position, a portion of the body blocks the hammer assembly from contacting the firing pin, and a circumferential surface depresses the ejector and magazine depressor lever and firing pin safety lever. Rotation of the cylindrical body within the slide assembly is not prevented by an active locking mechanism, however it is resisted by friction and spring tension created by a spring-biased pin carried in a transverse bore in the cylindrical body and riding within a channel in the slide assembly. One or both of the axial ends of the cylindrical body may be recessed from the sides of the slide assembly, polished to further prevent or evidence tampering, and the axial end opposing the keyway may optionally be covered. The semi-automatic pistol thereby has no manual safety lever which may be operated by the user.

DESCRIPTION OF THE PREFERRED EMBODIMENTS

The passive safety mechanism for firearms of this invention are shown in FIGS. 1–8 and referenced generally therein by the numeral 10.

The passive safety mechanism 10 is shown for reference and descriptive purposes installed in a semi-automatic pistol 12. Although many types of firearms, handguns, or pistols are suitable for use with or may be modified to accommodate the passive safety mechanism 10, a Smith & Wesson Model 1076 10 mm. semi-automatic pistol 12 is shown as a representative example of the manner and best mode contemplated for utilizing the passive safety mechanism 10 as described herein.

Figure 1:
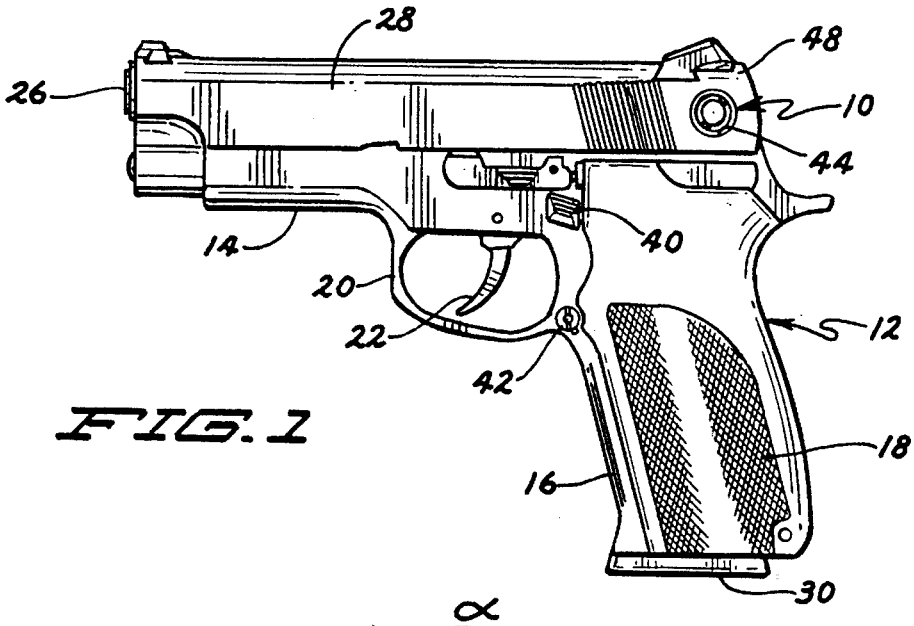
FIG. 1 is a side elevation view of a semi-automatic pistol as further described in the specification incorporating the passive safety mechanism of this invention in the disengaged position.
Figure 2:
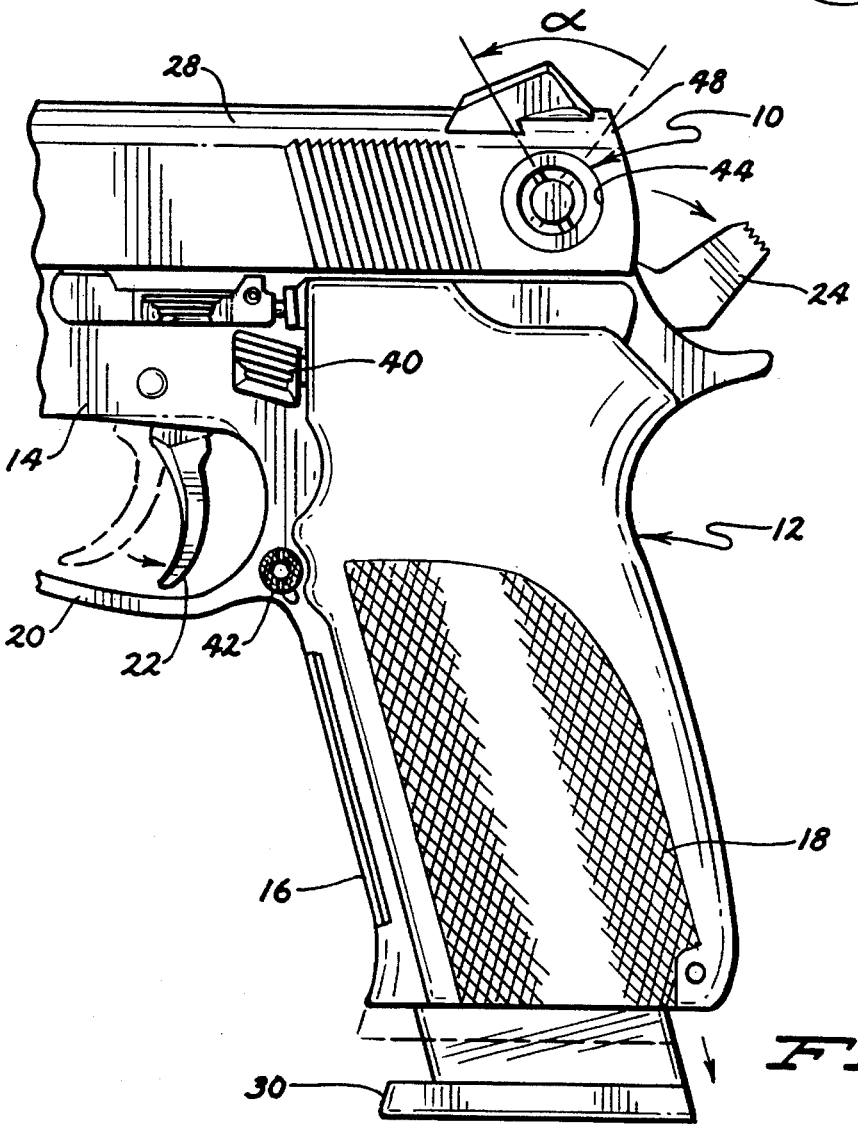
FIG. 2 is a detail view of rear portion of the semi-automatic pistol of FIG. 1 showing the passive safety mechanism in the engaged position.
Figure 3:
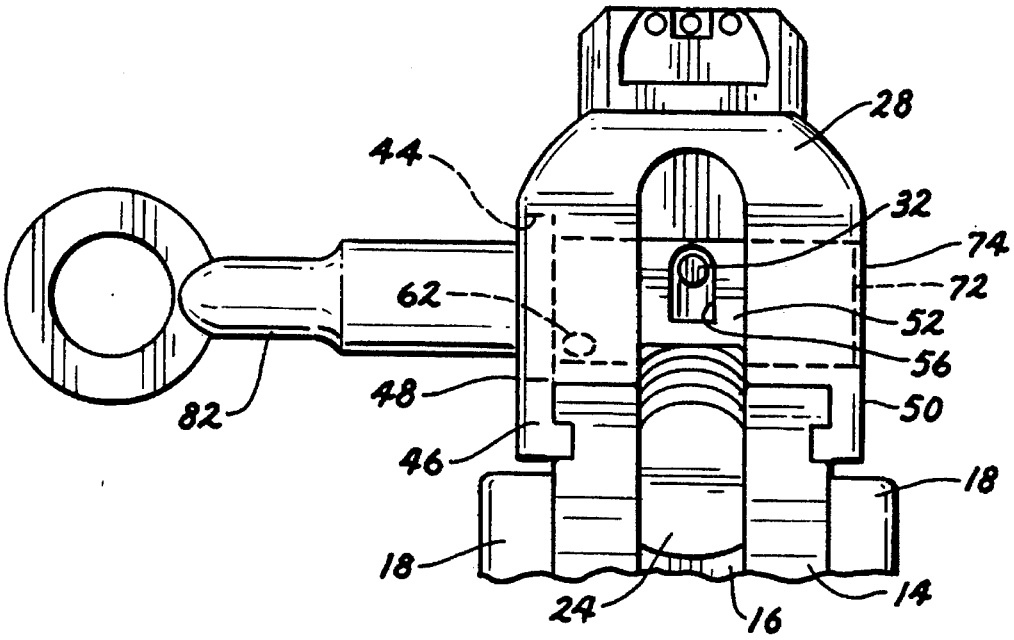
FIG. 3 is a rear elevation view of the top portion of the semi-automatic pistol of FIG. 1 showing the passive safety mechanism in the disengaged position.

Referring particularly to FIGS. 1–3, it may be seen that the semi-automatic pistol 12 includes a frame 14 defining a butt or handgrip region 16 covered on both sides by wood or polymer handgrips 18. The frame 14 defines a trigger guard 20 disposed in front of the handgrip region 16, and protecting a trigger assembly 22 that is pivotally mounted within the frame 14 and movable between a rest position as shown in FIG. 1 and a firing position as shown in FIG. 2. It will be understood by those of skill in the art that the trigger assembly 22 is operatively connected by a series of internal mechanisms (not shown) to a hammer assembly 24 positioned at the rear of the frame 14. The hammer assembly 24 is pivotally mounted within the frame 14 and spring-biased to move between a cocked or ready position as shown in FIG. 2 and a firing or rest position as shown in FIG. 1 in response to the trigger 22 being retracted completely to the firing position.

The semi-automatic pistol 12 may be fired or discharged in one of two ways. A round of ammunition (not shown) is chambered at or within the rear or breach end of the barrel 26 by retracting the slide assembly 28 rearwardly along the frame 14 and then forwardly to strip the round from the top of the clip or magazine 30 and dispose that round within the enclosed firing chamber at the breach end of the barrel 26. The process of chambering the round also draws the hammer assembly 24 rearwardly to the cocked position, at which point the hammer assembly is caught and held by a sear (not shown) while the slide assembly 28 returns to the normal position as shown in FIG. 2. The trigger assembly 22 can then be manually retracted (or "squeezed") until the trigger assembly 22 reaches the firing position, at which point the sear releases the hammer assembly 24 and the hammer assembly 24 pivots forward and strikes the firing pin 32 along its rear face 34. The firing pin 32 is slidably carried within the frame 14 and is spring-biased rearwardly by a compression spring 36. However, the force of the hammer assembly 24 striking the rear face 34 of the firing pin 32 is sufficient to overcome the spring force of the compression spring 36 and propel the firing pin 32 forward until the front section 38 strikes the primer (nor shown) in the rear of the round to cause the round to fire. The force of the round discharging serves to propel the round's projectile through the barrel 26 and also drives the slide assembly 28 rearwardly to eject the spent cartridge from the chamber and strip a second round of ammunition from the magazine 30, cock the hammer assembly 24, and place the semi-automatic pistol 12 in position to fire that second round.

Alternately, once the semi-automatic pistol 12 has been cocked by retracting the slide assembly 28 as described above, the semi-automatic pistol 2 may be decocked by pressing the pivotally-mounted and spring-biased decocking lever 40 downwardly, thus causing a decocking mechanism (not shown) to release the sear and controllably lower the hammer assembly 24 toward the slide assembly 28 and firing pin 32. In some semi-automatic pistols 12 such as that shown in FIG. 1, the decocking mechanism lowers the hammer assembly 24 only to a partially cocked or stopped position and prevents contact between the hammer assembly 24 and firing pin 32, with the hammer assembly 24 being manually dropped to the rest position within the rear of the slide assembly 24 by placing rearward tension on the hammer assembly 24 and retracting the trigger assembly 22 slightly.

From this rest position, the semi-automatic pistol 12 of the double-action type may be fired by manually squeezing or retracting the trigger assembly 22 to draw the hammer assembly 24 rearwardly against the spring tension until the trigger assembly 22 reaches the firing position, at which point the sear releases the hammer assembly 24 and the hammer assembly 24 similarly pivots forward and strikes the firing pin 32 to discharge the round in the chamber.

The magazine 30 may be released and withdrawn from the butt or handgrip region 16 of the frame 14 by depressing a spring-biased magazine catch 42 disposed directly behind the trigger guard 20. The magazine 30 can then be slidably removed from within the handgrip region 16, loaded with additional rounds of ammunition, and slidably inserted into its recess within the handgrip region 16 until the magazine catch 42 engages and holds the magazine 30 in position.

Other features and mechanisms of the semi-automatic pistol 12 will be apparent from the description of the structure and operation of the passive safety mechanism 10 which follows, however such features and mechanisms are within the basic understanding of one of ordinary skill in the art, and the incorporation of the passive safety mechanism 10 of this invention into other semi-automatic pistols 12, handguns, or firearms having features or mechanisms which differ structurally or functionally from those described herein may be readily appreciated by those skilled in the art.

Referring particularly to FIGS. 1–4, the passive safety mechanism 10 is shown mounted or installed within the slide assembly 28 of the semi-automatic pistol 12 at the rear end thereof, and closely proximate to the front of the hammer assembly 24. It will be readily appreciated by those skilled in the art that the passive safety mechanism 10 is received within a pair of circular apertures 44 defined in each side wall of the slide assembly 28 normally disposed for receiving the firing pin retainer, and the passive safety mechanism 10 extends substantially between the two opposing sides 48, 50 of the slide assembly 28 and is rotatably mounted therein in substantially the same manner as the firing pin retainer. In the case of a conventional semi-automatic pistol 12 not incorporating the passive safety mechanism 10, one or both ends of the firing pin retainer would be fitted with or define manual safety levers (not shown), with one manual safety lever being disposed on each side of the slide assembly 28 and handgrip region 16 in the case of an ambidextrous manual safety. The manual safety levers are manually pivoted by the user's thumb to rotate the firing pin retainer transversely within the slide assembly 28 to actively engage or disengage the manual safety function of the semi-automatic pistol 12.

Referring to FIGS. 1–4, 7, and 8, it may be seen that the passive safety mechanism 10 defines a generally cylindrical body 52 with an outwardly projecting annular collar 54 at one end thereof which is matingly received within the aperture 44 of the side wall 46 of the slide assembly 28, thus requiring that the passive safety mechanism 10 be installed through the aperture 44 from that side 48 of the slide assembly 28.

Figure 5:
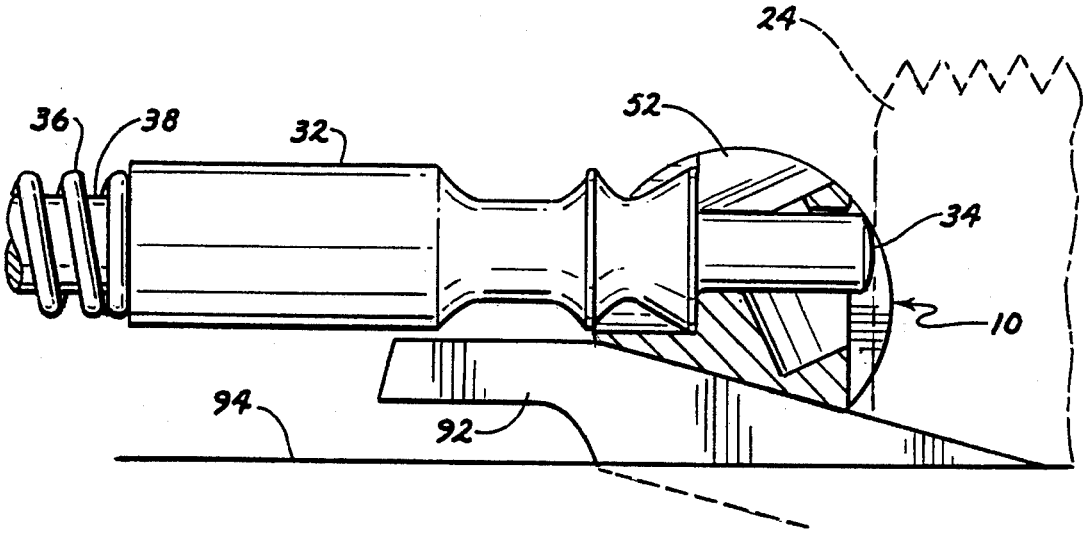
FIG. 5 is a partially broken away cross section view of the semi-automatic pistol of FIG. 1 and the passive safety mechanism in the disengaged position.

The body 52 of the passive safety mechanism 10 defines a central aperture 56 having a generally rectangular shape with a semi-circular top, the central aperture 56 extending completely through the diameter of the body 52 and defining a passage through which the rear face 34 of the firing pin 32 extends and may be contacted by the hammer assembly 24, as shown particularly in FIGS. 3 and 5.

The body 52 of the passive safety mechanism 10 further defines a bore 58 disposed closely adjacent to the annular collar 54 and extending partially through the diameter of the body 52, the bore 58 slidably receiving a pin 60 having a rounded head 62 and biased radially outward from the body 52 by a compression spring 64 disposed within the bore 58 and received within the base 66 of the pin 60.

The rounded head 62 of the pin 60 extends and is biased outwardly into contact with the surface of a generally square-cornered recess or channel 68 defined by and extending into the rear surface of the side wall 46 of the slide assembly 28, and therefore communicating with the aperture 44 and closely confronting the cylindrical surface of the body 52 of the passive safety mechanism 10. It may be readily appreciated by those of ordinary skill in the art that the pin 60, spring 64, and channel 68 are of the same type, placement, orientation, and configuration as those provided for the manual safety plunger and spring in a conventional semi-automatic pistol 12 not incorporating the passive safety mechanism 10, with the exception of the optional modifications described in greater detail herein.

Figure 7:
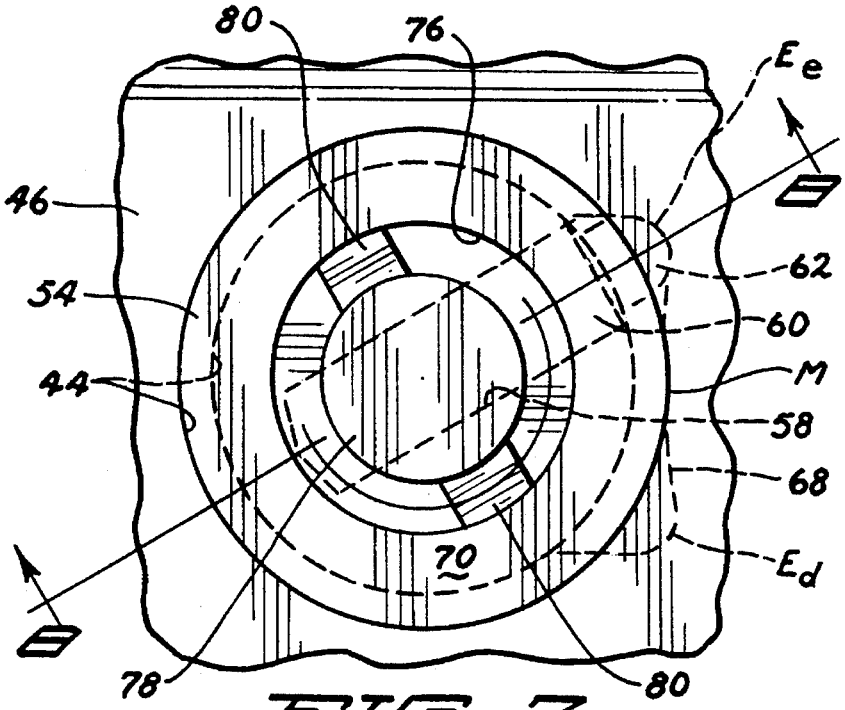
FIG. 7 is a side elevation detail view of the passive safety mechanism installed in the semi-automatic pistol of FIG. 1.
Figure 8:
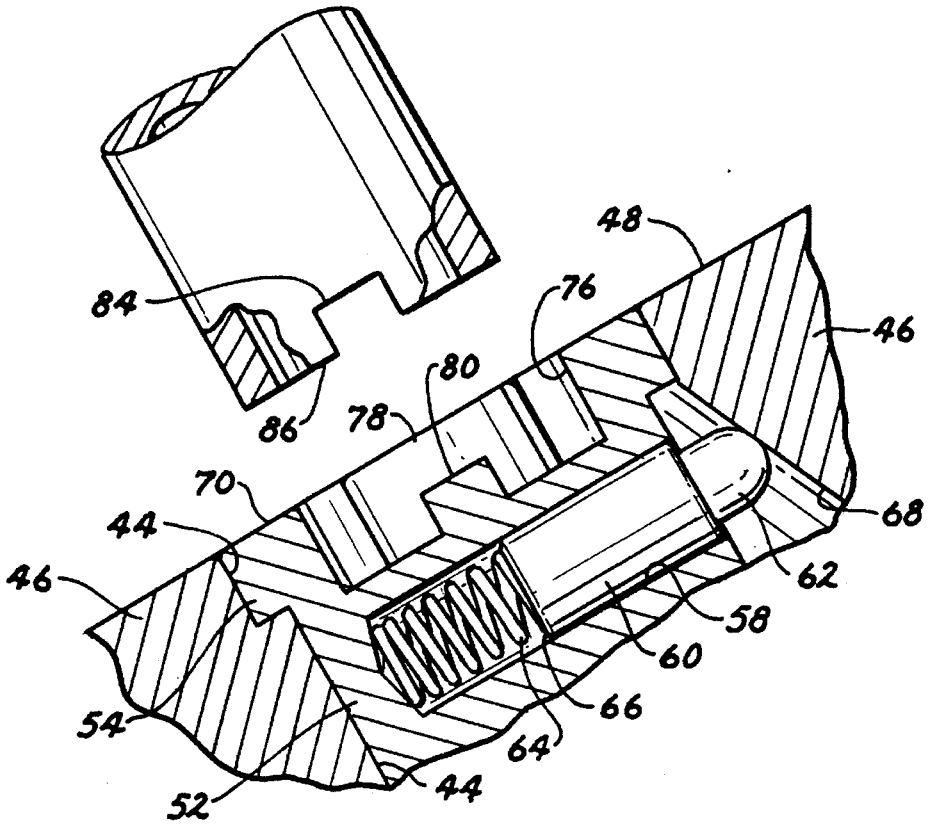
FIG. 8 is a partially broken away cross-sectional view of the passive safety mechanism taken through line 8—8 in FIG. 7.

Referring to FIGS. 7 and 8, it may be seen that the channel 68 defines an angularly oriented surface contacting the rounded head 62 of the pin 60, and is located and oriented such that the surface is tangential or more closely adjacent to the peripheral edge or circumference of the body 52 of the passive safety mechanism 10 at or near the midpoint M thereof, and is deeper or more distantly displaced from peripheral edge or circumference of the body 52 at the opposing ends $E_e$, $E_d$ thereof.

Referring again to FIGS. 1–4, 7, and 8, the body 52 of the passive safety mechanism 10 has a first axial end 70 disposed substantially flush with one side 48 of the slide assembly 28, and a second axial end 72 disposed substantially flush with other side 50 of the slide assembly 28. One or both of the axial ends 70, 72 may optionally be recessed slightly into the interior of the slide assembly 28 from the corresponding sides 48, 50 of the slide assembly 28 as shown with reference to the second axial end 72 in FIGS. 3 and 4, in order to further mitigate against any unauthorized use, tampering with, or circumvention of the passive safety mechanism 10. The second axial end 72 may optionally be enclosed by the corresponding side wall 46 of the slide assembly 28, or by a separate cap 74 which extends across and encloses the aperture 44 in the corresponding side wall 46 of the slide assembly 28 in covering relation to the second axial end 72 of the body 52 of the passive safety mechanism 10.

The body 52 of the passive safety mechanism 10 further defines a generally circular concentric keyway 76 extending longitudinally into the first axial end 70 of the body 52 generally parallel with and circumscribing the longitudinal axis or axis of rotation of the body 52 and perpendicular to the first axial face 70. The concentric keyway 76 further defines a central post 78 having a circular cross-section extending longitudinally outward from the body 52 and aligned with the longitudinal axis thereof, and a pair of generally rectangular cross -section flanges 80 extending between the central post 78 and the concentric keyway 76 and diametrically opposed to one another. In a retrofit embodiment of the passive safety mechanism 10, the concentric keyway 76 and central post 78 were formed by machining an annular groove into the first axial face 70 of the body 52, and the flanges 80 were formed by drilling a circular bore transversely through the body 52 and intersecting the annular groove and central post 78 with a rod having three rectangular surfaces cut corresponding to the flanges 80 inserted through the bore so that the rectangular surfaces are disposed within the concentric keyway 76. For production of non-retrofit embodiments, the entire concentric keyway 76, central post 78, and flanges 80 may be machined into the first axial face 70 of the body using an EDM or similar machining process.

A hollow cylindrical or tubular key 82 or other actuating device having a gripping portion and an inner and outer diameter corresponding to the diameter of the concentric keyway 76 and central post 78, respectively, defines a pair of generally rectangular notches 84 aligned to receive and engage the pair of flanges 80 when the distal end 86 of the key 82 is inserted completely into the concentric keyway 76.

Clockwise rotation of the key 82 within the keyway 76 when the flanges 80 are engagingly received within the notches 84 causes clockwise rotation of the body 52 of the passive safety mechanism 10 within the slide assembly 28 through an angle $\alpha$ of approximately 65° between the safety or engaged position shown in FIGS. 2, 4, 6, and 7, and the firing or disengaged position shown in FIGS. 1, 3, and 5.

Referring particularly to FIG. 3–6, it may be seen that counter-clockwise rotation of the body 52 of the passive safety mechanism 10 from the disengaged position to the engaged position causes a semi-circular rear block 88 of the body 52 to be disposed operatively between the hammer assembly 24 and the rear face 34 of the firing pin 32 in separating relation thereto to prevent the hammer assembly 24 from being completely received within the slide assembly 28 and contacting the firing pin 32. Additionally, the body 52 of the passive safety mechanism 10 presses the firing pin 32 a short distance D forward as would normally occur when the manual safety of the semi-automatic pistol 12 were moved to the "on" position, and the cylindrical outer surface 90 of the body 52 of the passive safety mechanism 10 depresses the ejector and magazine depressor lever 92 and/or the firing pin safety lever 92 and slide assembly release (not shown) downwardly to a point flush with the top surface 94 of the frame 14 in the area beneath passive safety mechanism 10 and within the slide assembly 28, to thereby disable magazine catch 42 and the operative connection between the trigger assembly 22 and the sear or hammer assembly 24. (In FIGS. 5 and 6, the lever shown as reference numeral 92 may represent either the ejector and magazine depressor lever 92 or the firing pin safety lever 92 or both, which are normally disposed on opposing sides of the hammer assembly 22 and firing pin 32.)

The semi-circular rear block 88 of the body 52 is described as being "disposed operatively between" the hammer assembly 24 and the rear face 34 of the firing pin 32. In the embodiment shown in FIGS. 3–8 herein, at least a portion of the semi-circular rear block 88 of the body 52 is physically disposed between the hammer assembly 24 and the rear face 34 of the firing pin 32 to prevent firing. In alternate embodiments, a portion of the passive safety mechanism 10 may be operatively disposed between the hammer assembly 24 and the firing pin 32 in any manner that prevents the hammer assembly 24 from contacting the firing pin 32 without necessarily requiring physical interposition between those two elements, but rather by functionally blocking the hammer assembly 24 from the firing pin 32, or functionally disconnecting the hammer assembly 24 from the trigger assembly 22.

In operation, when the passive safety mechanism 10 is rotated to the disengaged position as shown in FIGS. 1, 3, and 5, the semi-automatic pistol 12 may be operated and fired by the user according to any procedure that is normally utilized.

Figure 4:
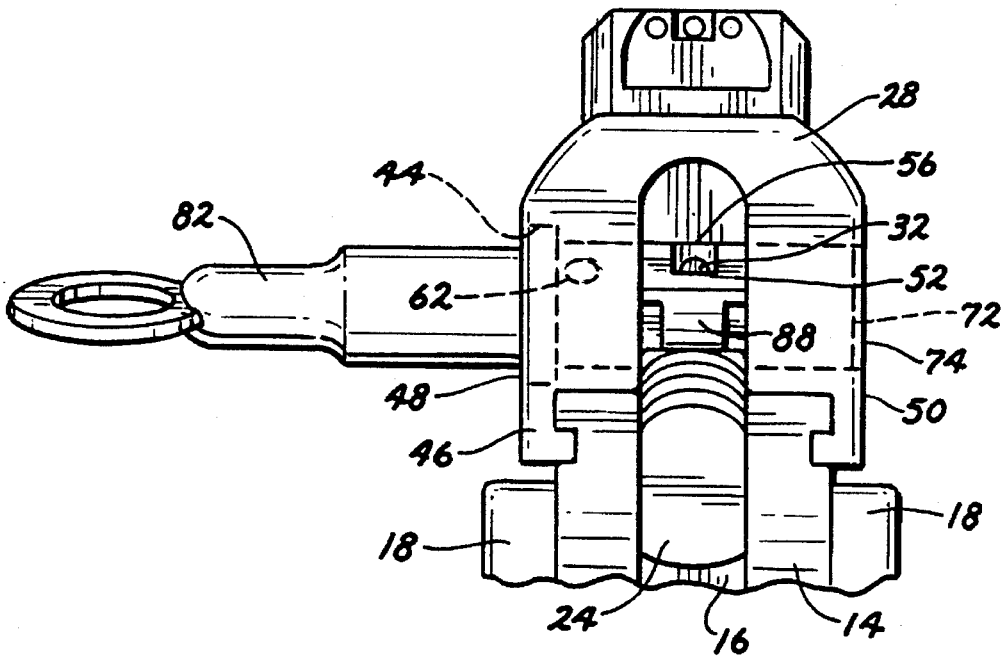
FIG. 4 is a rear elevation view of the top portion of the semi-automatic pistol of FIG. 1 showing the passive safety mechanism in the engaged position.
Figure 6:
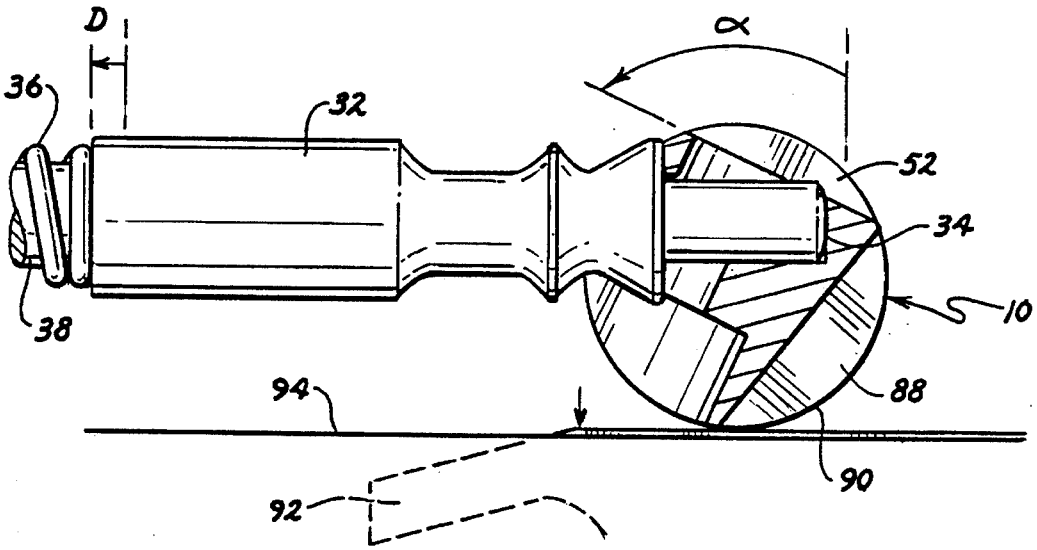
FIG. 6 is a partially broken away cross section view of the semi-automatic pistol of FIG. 1 and the passive safety mechanism in the engaged position.

In order to move the passive safety mechanism to the engaged position as shown in FIGS. 2, 4, and 6, the magazine catch 42 must be depressed and the magazine 30 at least partially removed from within the handgrip region 16 of the frame as shown in FIG. 2, and the distal end 86 of the key 82 must be inserted into the concentric keyway 76 until the notches 84 engage the flanges 80 of the passive safety mechanism 10 and is rotated counter-clockwise to the engaged position. This may be performed regardless of whether the hammer assembly 24 is in the cocked position, the rest position, or the partially cocked position, and will have no effect on the movement or positioning of the hammer assembly 24. When the passive safety mechanism 10 is rotated to the engaged position, the trigger assembly 22 cannot be retracted and will not affect the sear or hammer assembly 24, however the hammer assembly 24 may still be lowered to the partially decocked or fully decocked rest position using the decocking lever 40 and corresponding mechanism. Similarly, the slide assembly 28 may be retracted fully to cock the hammer assembly 24. Finally, when the passive safety mechanism 10 is rotated to the engaged position, the magazine 30 cannot be inserted completely into the interior of the handgrip region 16 of the frame 14 so that the magazine catch 42 engages and retains the magazine 30 with a round of ammunition in position to be chambered if the slide assembly 28 is fully retracted to cock the hammer assembly 24, thereby also preventing a round of ammunition from being chambered from the magazine 30 by operation of the slide assembly 28.

The key 82 may then be withdrawn from the concentric keyway 76 of the passive safety mechanism 10 and the passive safety mechanism 10 will remain in the engaged position and will resist rotation of the passive safety mechanism 10 due to the spring tension and frictional resistance caused by the pin 60 and spring 64. The friction and spring tension should be sufficient that a person could not normally grip the opposing first and second axial ends 70, 72 of the body 52 and manually rotate the passive safety mechanism 10, nor grip the substantially smooth axial ends 70, 72 using a pliers or similar tool and manually rotate the passive safety mechanism.

To fire or operate the semi-automatic pistol 12, the key 82 must be reinserted into the concentric keyway 76 and the passive safety mechanism 10 rotated to the disengaged position, whereat the magazine 30 may be inserted completely into the interior of the handgrip region 16 of the frame 14 so that the magazine catch 42 engages and retains the magazine 30, and the semi-automatic pistol 12 is thereafter fully operation for firing according to any procedure normally utilized.

Various modifications may be made to the passive safety mechanism 10 to further mitigate against tampering, unauthorized use, or circumvention of the passive safety mechanism 10 when in the engaged position, including deepening the engaged end $E_e$ of the channel 68, modifying the shape of the rounded head 62 of the pin 60, increasing the spring constant of the compression spring 64, smoothing or polishing the second axial end 72 of the body 52 of the passive safety mechanism 10 in addition to recessing that second axial end 72, and fabricating a more complex configuration for the concentric keyway 76 and key 82 that does not present any exposed or visible flanges 80.

Other embodiments of or modifications to the passive safety mechanism 10 of this invention have been contemplated to be particularly useful or desired for certain applications. One example is a passive safety mechanism 10 in which the body 52 defines a groove in the rear block 88 which receives the ejector and magazine depressor lever 92 regardless of the rotational orientation of the passive safety mechanism 10 (but not the firing pin safety lever), thereby permitting a holstered semi-automatic pistol 12 to have the passive safety mechanism 10 engaged without removing the magazine 30 or disengaging the magazine catch 42.

The passive safety mechanism 10 shows the drawing figures is oriented for a right-handed shooter. For left-handed shooters or ambidextrous operation, the concentric keyway 76 need only be placed on the opposite or second axial end 72 of the body 52, or the body 52 may be equipped with two completely operational concentric keyways 76 at each of the first and second axial ends 70, 72 thereof.

For purposes readily apparent to one of ordinary skill in the art, it is understood that in this specification and the claims appended hereto the slide assembly 28 may be considered as one component of the frame 14, although the slide assembly 28 is more conventionally considered a separate and distinct component from the remainder of the frame 14.

While the preferred embodiments of the above passive safety mechanism 10 have been described in detail with reference to the attached drawing figures, it is understood that various changes and adaptations may be made in the passive safety mechanism 10 without departing from the spirit and scope of the appended claims.

What is claimed is:

1. In a firearm to be used by a person having a thumb and a forefinger, said firearm having a frame, a firing pin, and a hammer, said hammer being mounted on said frame for movement between a cocked position and a firing position in contact with said firing pin, the improvement comprising:

a passive safety mechanism, said passive safety mechanism having a body mounted on the frame, said body being movable between an engaged position and a disengaged position, at least a portion of said body being disposed operatively between the hammer and the firing pin when the passive safety mechanism is in the engaged position such that the hammer is prevented from contacting the firing pin, said passive safety mechanism having at least one surface exposed to the person and including a keyway; and a key for actuating said passive safety mechanism, said key having an engaging portion configured so as to operatively mate with said keyway, said body being substantially free of and not operatively connected to a surface which may be gripped or engaged by the thumb or the forefinger or both of the person such that the person may not manually move said passive safety mechanism between said engaged position and said disengaged position except by use of said key, whereby the person may engage the keyway of the passive safety mechanism with the key and move the passive safety mechanism between said engaged position and said disengaged position.

2. The passive safety mechanism of claim 1 wherein the body has a generally cylindrical shape including a first end and a second end, said first end defining the at least one surface exposed to the person and including the keyway, said first end and said second end being disposed on opposing sides of the frame of firearm.

3. The passive safety mechanism of claim 2 wherein the firearm is a semi-automatic pistol and the frame includes a slide assembly, and wherein the body is mounted for rotational movement on said slide assembly.

4. The passive safety mechanism of claim 3 wherein the first end of the body and the second end of the body are disposed on opposing sides of the slide assembly.

5. The passive safety mechanism of claim 4 wherein a portion of the second end of the body is exposed to the person.

6. The passive safety mechanism of claim 5 wherein the portion of the second end of the body that is exposed to the person is substantially smooth.

7. The passive safety mechanism of claim 6 wherein the opposing sides of the slide assembly include a first side proximate to the first end of the body and a second side proximate to the second end of the body, and wherein the second end of the body is recessed from said second side of the slide assembly.

8. The passive safety mechanism of claim 1 wherein the body is mounted for rotational movement relative to the frame, and further including means for biasing the body against rotational movement.

9. The passive safety mechanism of claim 1 wherein the body is mounted for rotational movement relative to the frame and is spring-biased against rotational movement by a pin and a compression-type spring, the body defining a bore receiving said compression-type spring and at least a portion of said pin, said frame defining a channel, at least a second portion of said pin being biased toward and into contact with said channel by said compression-type spring, said channel being disposed such that rotational movement of the body relative to the frame presses said pin against said compression-type spring and further into said bore.

10. The passive safety mechanism of claim 9 wherein the spring-bias exerted on the body is sufficient to prevent the person from manually moving the passive safety mechanism from the engaged position to the disengaged position using the thumb or the forefinger or both.

11. The passive safety mechanism of claim 1 wherein the firearm has an ejector and magazine depressor lever pivotably mounted on the frame for movement between an operative position and an inoperative position, wherein said ejector and magazine depressor lever is pivotably depressed in said inoperative position relative to said operative position, and wherein the body engages and pivotably depresses said ejector and magazine depressor lever relative to the frame such that said ejector and magazine depressor lever is in said inoperative position when the body of the passive safety mechanism is moved to the engaged position.

12. The passive safety mechanism of claim 1 wherein the firearm has a firing pin safety lever pivotably mounted on the frame for movement between an operative position and an inoperative position, wherein the firing pin safety lever is pivotably depressed in said inoperative position relative to said operative position, and wherein the body engages and pivotably depresses said firing pin safety lever relative to the frame such that said firing pin safety lever is in said inoperative position when the body of the passive safety mechanism is moved to the engaged position.

13. A method for selectively preventing the firing of a firearm by a person having a thumb and a forefinger, said firearm having a frame, a firing pin, and a hammer, said hammer being mounted on said frame for movement between a cocked position and a firing position in contact with said firing pin, said method comprising the steps of:

providing the firearm with a passive safety mechanism, said passive safety mechanism having a body removably mounted on the frame, said body being movable between an engaged position and a disengaged position, at least a portion of said body being disposed operatively between the hammer and the firing pin when the passive safety mechanism is in the engaged position such that the hammer is prevented from contacting the firing pin, said passive safety mechanism having at least one surface exposed to the person and including a keyway; and providing the person with a removable key for actuating said passive safety mechanism, said key having an engaging portion configured so as to operatively mate with said keyway, said body being substantially free of and not operatively connected to a surface which may be gripped or engaged by the thumb or the forefinger or both of the person such that the person may not manually move said passive safety mechanism between said engaged position and said disengaged position except by use of said key, whereby the person may selectively engage the keyway of the passive safety mechanism with the key and move the passive safety mechanism between the engaged position and the disengaged position.

14. The method of claim 13 and further including:

removing the key from the keyway after disposing said body in said engaged position.

* * * * *